US009854373B2

(12) United States Patent
Liu et al.

(10) Patent No.: US 9,854,373 B2
(45) Date of Patent: Dec. 26, 2017

(54) HEADPHONE SOCKET

(71) Applicant: Huawei Technologies Co., Ltd., Shenzhen (CN)

(72) Inventors: Xuelong Liu, Shenzhen (CN); Huogen Kuang, Shanghai (CN); Wei Su, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/314,986

(22) PCT Filed: May 30, 2014

(86) PCT No.: PCT/CN2014/079014

§ 371 (c)(1),
(2) Date: Nov. 30, 2016

(87) PCT Pub. No.: WO2015/180182

PCT Pub. Date: Dec. 3, 2015

(65) Prior Publication Data

US 2017/0201842 A1 Jul. 13, 2017

(51) Int. Cl.
*H04R 1/10* (2006.01)
*H04R 29/00* (2006.01)
(Continued)

(52) U.S. Cl.
CPC ..... *H04R 29/001* (2013.01); *H01R 13/187* (2013.01); *H01R 24/58* (2013.01); *H04R 1/1025* (2013.01); *H01R 2107/00* (2013.01)

(58) Field of Classification Search
CPC .... H04R 1/1025; H04R 29/001; H01R 24/58; H01R 2107/00; H01R 13/187
(Continued)

(56) References Cited

U.S. PATENT DOCUMENTS 9,319,768 B2 * 4/2016 Larsen ..... H04R 1/1041
2013/0083927 A1 * 4/2013 Savant ..... H04R 1/1025 381/2
2014/0064512 A1 * 3/2014 Yu ..... H04R 1/1041 381/74

FOREIGN PATENT DOCUMENTS

CN 2560126 Y 7/2003
CN 103248976 A 8/2013
(Continued)

OTHER PUBLICATIONS

Machine Translation and Abstract of Chinese Publication No. CN2560126, Jul. 9, 2003, 7 pages.
(Continued)

*Primary Examiner* — Paul S Kim
(74) *Attorney, Agent, or Firm* — Conley Rose, P.C.

(57) ABSTRACT

A headphone socket that includes: a headphone socket body and a spring plate part; the spring plate part is clamped into the headphone socket body, and the spring plate part includes: a microphone spring plate, a grounded spring plate, a right-earpiece spring plate, a charging detection availability identifying spring plate, a headphone availability detection spring plate, and a left-earpiece spring plate; and when a headphone plug of headphones is completely inserted into the headphone socket, the charging detection availability identifying spring plate is in contact with a right-channel terminal of the headphone plug, so as to conduct a connection between the right-channel terminal and an external circuit, so that a device at which the headphone socket is located charges the headphones by using the microphone spring plate that is in contact with a microphone terminal of the headphone plug.

7 Claims, 5 Drawing Sheets

(51) Int. Cl.

| | |
|---|---|
| ***H01R 24/58*** | (2011.01) |
| ***H01R 13/187*** | (2006.01) |
| *H01R 107/00* | (2006.01) |

(58) Field of Classification Search
USPC ..... 381/74, 77
See application file for complete search history.

(56) References Cited

FOREIGN PATENT DOCUMENTS

| | | | |
|---|---|---|---|
| CN | 103260105 | A | 8/2013 |
| CN | 203377444 | U | 1/2014 |
| CN | 103682724 | A | 3/2014 |
| JP | 2001126832 | A | 5/2001 |
| WO | 2013090932 | A1 | 6/2013 |

OTHER PUBLICATIONS

Machine Translation and Abstract of Chinese Publication No. CN103682724, Mar. 26, 2014, 6 pages.
Machine Translation and Abstract of Chinese Publication No. CN203377444, Jan. 1, 2014, 5 pages.
Machine Translation and Abstract of Japanese Publication No. JP2001126832, May 11, 2001, 7 pages.
Foreign Communication From A Counterpart Application, Chinese Application No. 201480002058.8, Chinese Office Action dated Jan. 26, 2017, 7 pages.
Foreign Communication From A Counterpart Application, European Application No. 14893367.4, Extended European Search Report dated Mar. 20, 2017, 9 pages.
Foreign Communication From A Counterpart Application, PCT Application No. PCT/CN2014/079014, English Translation of International Search Report dated Feb. 27, 2015, 2 pages.
Foreign Communication From A Counterpart Application, PCT Application No. PCT/CN2014/079014, English Translation of Written Opinion dated Feb. 27, 2015, 5 pages.

* cited by examiner

HEADPHONE SOCKET

CROSS-REFERENCE TO RELATED APPLICATIONS

This application is a national stage application of international patent application number PCT/CN2014/079014 filed on May 30, 2014, which is incorporated by reference.

TECHNICAL FIELD

The present disclosure relates to the field of mobile communications technologies, and in particular, to a headphone socket that can be used to charge headphones.

BACKGROUND

Headphones are people's portable stereo. Nowadays, there is an increasingly elaborated requirement on classification of headphones, and selecting appropriate headphones according to different occasions has become a symbol of a fashion lifestyle.

With an increasing requirement on sound quality, headphones such as active noise reduction headphones for improving sound quality frequently appear. The active noise reduction headphones receive an external sound by using a noise reduction microphone integrated on the headphones, and then generate a sound whose phase is opposite to that of external noise, to offset the noise, so that a user can listen to a better sound effect. Therefore, the active noise reduction headphones are especially suitable for people who are often on a business trip, for example, businessmen and office workers, to use in an aircraft cabin, a railway carriage, or a subway in which there is much noise. By using the noise reduction headphones, these users can not only keep away from interference of noise, but can also adjust mood by using the headphones, so as to fully enjoy the trip.

However, the active noise reduction headphones generally need to be powered by an external battery, and further, considering requirements for portability and appearance, there is a specific limitation on a size and weight of the external battery. Consequently, a capacity of the external battery is designed to be small, which cannot meet a requirement for long time use of a user. The user needs to frequently charge the headphones separately, which causes some inconvenience to the user.

SUMMARY

Embodiments of present disclosure provide a headphone socket, so that not only a function of a standard headphone socket but also a function of charging headphones can be implemented without increasing dimensions of the headphone socket.

According to a first aspect, an embodiment of the present disclosure provides a headphone socket, including: a headphone socket body and spring plate part; the spring plate part is clamped into the headphone socket body, and the spring plate part includes: a microphone spring plate, a grounded spring plate, a right-earpiece spring plate, a charging detection availability identifying spring plate, a headphone availability detection spring plate, and a left-earpiece spring plate; and the charging detection availability identifying spring plate is in contact with a right-channel terminal of a headphone plug that is inserted into the headphone socket, so that a device at which the headphone socket is located charges headphones by using the microphone spring plate that is in contact with a microphone terminal of the headphone plug.

In a first possible implementation manner, in a process of inserting the headphone plug into the headphone socket, the charging identifying detection spring plate is in contact with the right-channel terminal after the microphone spring plate is in contact with the microphone terminal of the headphone plug.

In a second possible implementation manner, in a process of pulling out the headphone plug from the headphone socket, the microphone spring plate breaks off contact with the microphone terminal of the headphone plug after the charging identifying detection spring plate breaks off contact with the right-channel terminal.

In a third possible implementation manner, a headphone jack is disposed at one end of the headphone socket body; there are opening structures respectively on two side walls of the headphone socket body; one end of each of the microphone spring plate, the grounded spring plate, the right-earpiece spring plate, the charging detection availability identifying spring plate, the headphone availability detection spring plate, and the left-earpiece spring plate stretches out of the headphone socket body from a corresponding opening structure and is connected to a circuit of the device at which the headphone socket is located; and the other end is in contact with the headphone plug that is inserted into the headphone socket.

According to the headphone socket in the embodiment of the present disclosure, a charging detection availability identifying spring plate is used to conduct a connection between a right-channel terminal and a circuit of a device at which the headphone socket is located, so that a microphone spring plate that is in contact with a microphone terminal of a headphone plug charges headphones. In this way, not only a function of a standard headphone socket but also a function of charging the headphones can be implemented without increasing dimensions of the headphone socket, so that it is more convenient for a user to use the headphones, and user experience is greatly improved.

The following further provides detailed descriptions of the technical solution in an embodiment of the present disclosure by using accompanying drawings and the embodiment.

DESCRIPTION OF EMBODIMENTS

Figure 1:
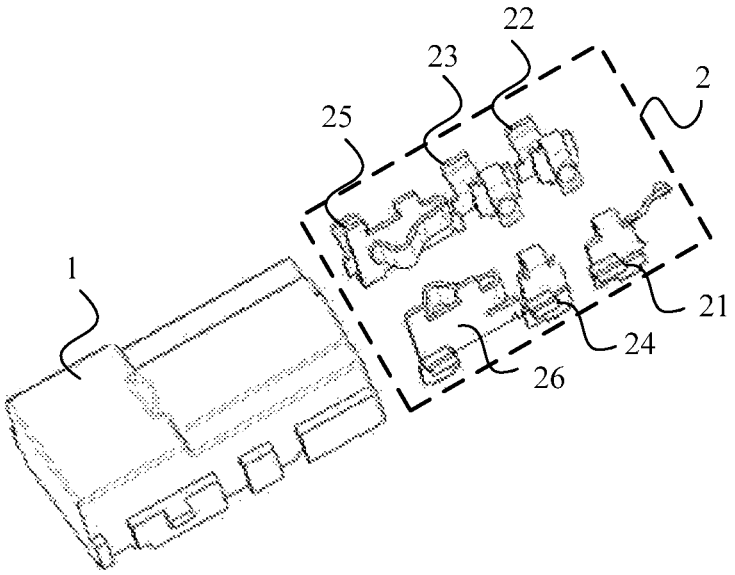
FIG. 1 is an exploded schematic diagram of a headphone socket according to an embodiment of the present disclosure.
Figure 2:
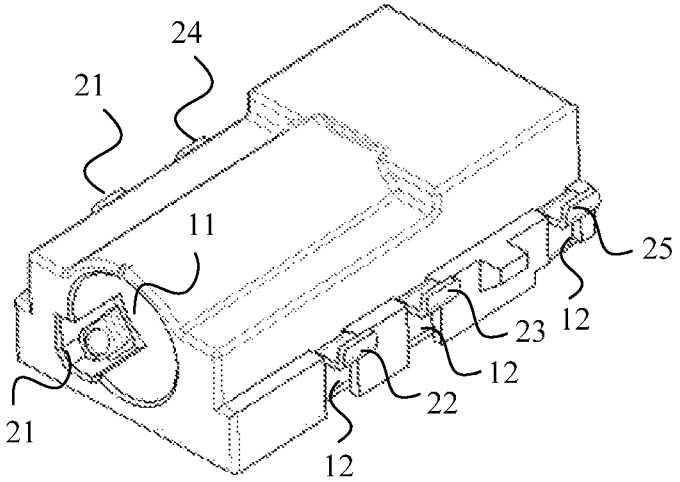
FIG. 2 is an assembly schematic diagram of a headphone socket according to an embodiment of the present disclosure.

The following first describes a headphone socket provided in an embodiment of the present disclosure in detail with reference to FIG. 1 and FIG. 2, where FIG. 1 is an exploded schematic diagram of a headphone socket according to an embodiment of the present disclosure, and FIG. 2 is an assembly schematic diagram of a headphone socket according to an embodiment of the present disclosure.

As shown in FIG. 1, the headphone socket includes: a headphone socket body 1 and a spring plate part 2, and the spring plate part 2 is clamped into the headphone socket body 1. The headphone socket body 1 is made of an insulation material, such as plastic; the spring plate part 2 is made of a conductive material, such as metal.

The spring plate part 2 includes a microphone spring plate 21, a grounded spring plate 22, a right-earpiece spring plate 23, a charging detection availability identifying spring plate 24, a headphone availability detection spring plate 25, and a left-earpiece spring plate 26.

With reference to FIG. 2, a headphone jack 11 is disposed at one end of the headphone socket body 1, and there are multiple opening structures 12 on side walls of the headphone socket body 1. One end of each of the foregoing spring plates stretches out of the headphone socket body 1 from a corresponding opening structure 12, and is used for connecting to an external circuit, for example, connecting to a printed circuit board (PCB), where the connecting may be specifically implemented in a welding manner, or the like. The other end is used to be in contact with a terminal of a headphone plug.

Specifically, the microphone spring plate 21, the charging detection availability identifying spring plate 24, and the left-earpiece spring plate 26 are sequentially clamped into one side wall of the headphone socket body 1 from an opening of the headphone jack 11 to the inside; the grounded spring plate 22, the right-earpiece spring plate 23, and the headphone availability detection spring plate 25 are sequentially clamped into the other side wall of the headphone socket body 1 from the opening of the headphone jack 11 to the inside, where a position of the left-earpiece spring plate 26 is corresponding to and may be swapped with a position of the headphone availability detection spring plate 25, and both the left-earpiece spring plate 26 and the headphone availability detection spring plate 25 are bending structures, and are used to clamp the headphone plug into the headphone socket when the headphone plug is being inserted into the headphone socket, so that the headphone plug is not prone to slipping out. A position of the charging detection availability identifying spring plate 24 is corresponding to a position of the right-earpiece spring plate 23, and a position of the grounded spring plate 22 is corresponding to a position of the microphone spring plate 21.

Figure 3:
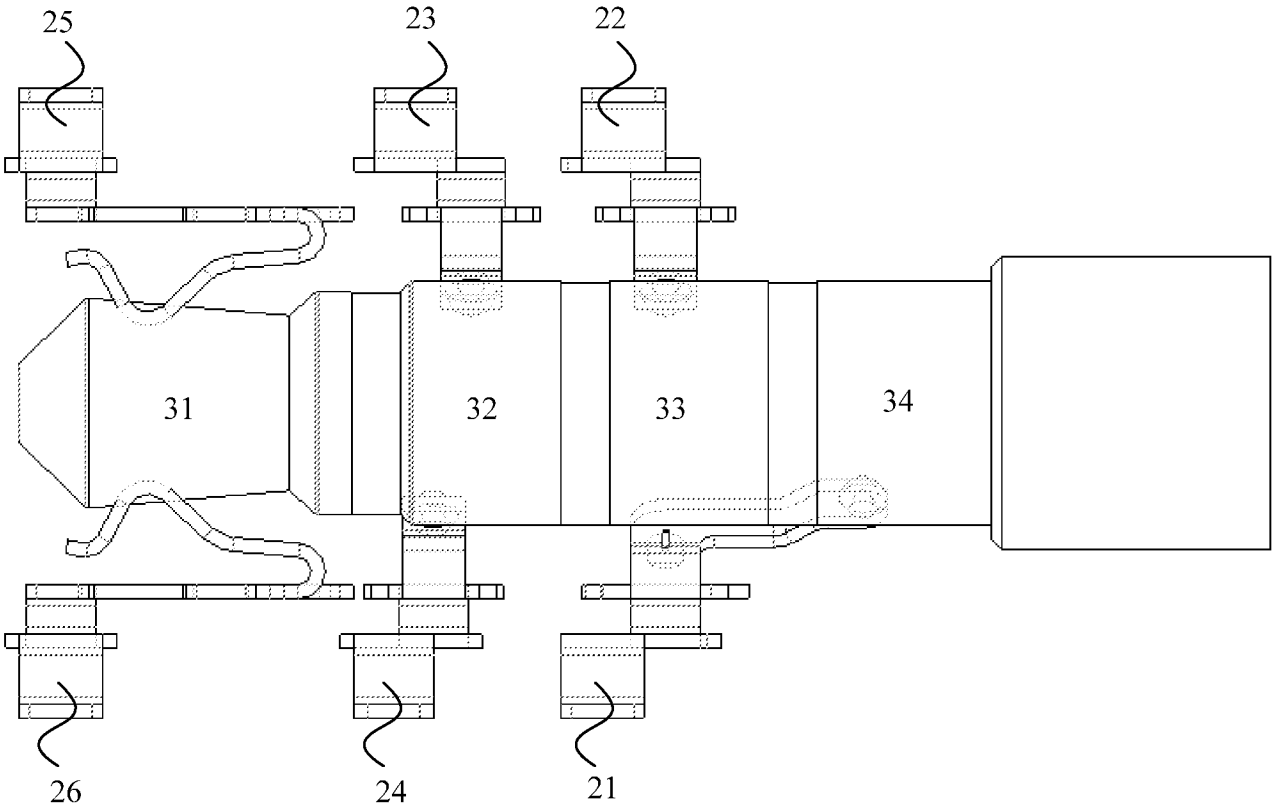
FIG. 3 is a schematic diagram of a first state of a headphone socket according to an embodiment of the present disclosure.

FIG. 3 shows a case in which the headphone plug is completely inserted into the headphone socket. The headphone availability detection spring plate 25 and the left-earpiece spring plate 26 are separately in contact with a left-channel terminal 31 of the headphone plug, the right-earpiece spring plate 23 and the charging detection availability identifying spring plate 24 are separately in contact with a right-channel terminal 32 of the headphone plug, the microphone spring plate 21 is in contact with a microphone terminal 34 of the headphone plug, and the grounded spring plate 22 is in contact with a grounded terminal 33 of the headphone plug.

When the headphone plug is completely inserted into the headphone socket, the charging detection availability identifying spring plate 24 is in contact with the right-channel terminal 32 of the headphone plug. The charging detection availability identifying spring plate 24 is used to conduct an electrical connection between the right-channel terminal 32 and a control circuit (not shown in the figure) of a device at which the headphone socket is located, so that detection performed by the control circuit of the device on headphones is in an effective charging detection connected state. The control circuit can generate a charging signal, so as to control the device to charge the headphones by using the microphone spring plate 21 that is in contact with the microphone terminal 34 of the headphone plug. In an actual operation, the control circuit further needs to consider whether a microphone is in a state of receiving an external sound. For example, when the device (such as a mobile phone or a tablet computer) at which the headphone socket is located is in a call, the microphone needs to receive a voice of a user, and in this case, the device does not charge the headphones by using the microphone spring plate 21 that is in contact with the microphone terminal 34 of the headphone plug; when the microphone is idle, that is, does not need to receive an external sound, the device charges the headphones by using the microphone spring plate 21 that is in contact with the microphone terminal 34 of the headphone plug.

Figure 4:
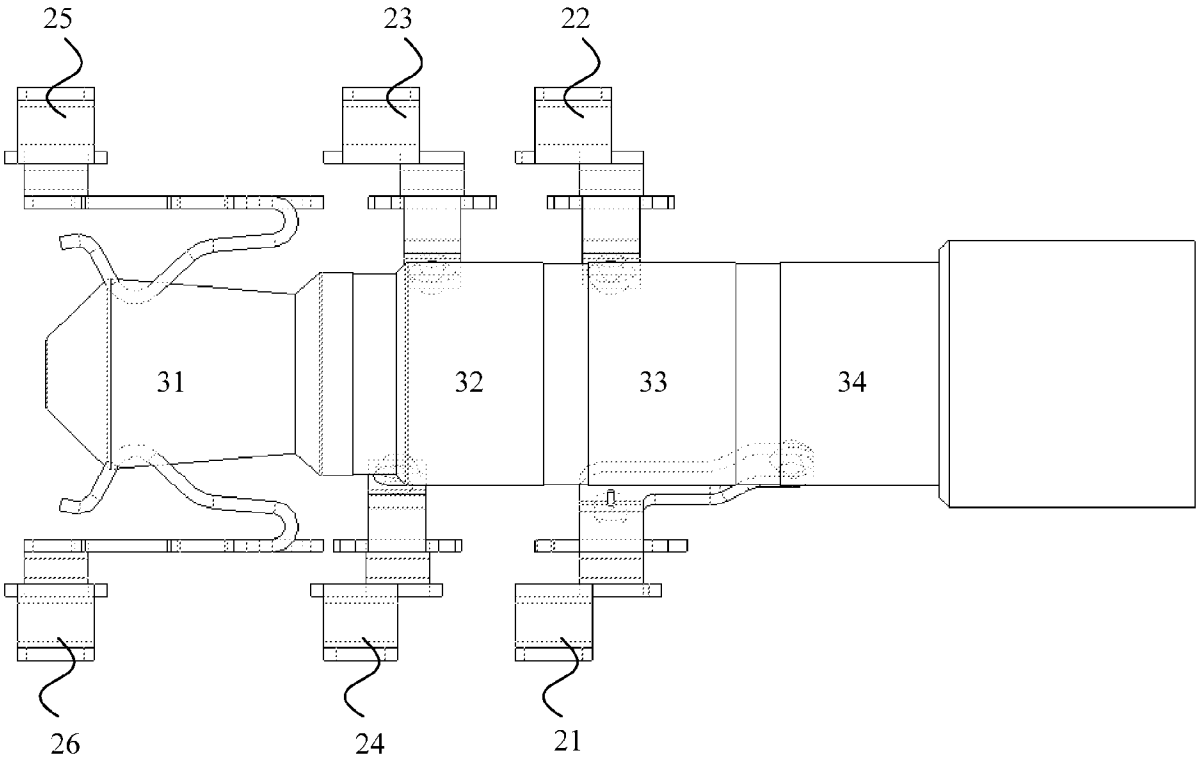
FIG. 4 is a schematic diagram of a second state of a headphone socket according to an embodiment of the present disclosure.

To avoid a problem that noise is generated due to instability of contact between the foregoing spring plates and the terminals, in a process of inserting the headphone plug into the headphone socket, the charging identifying detection spring plate is in contact with the right-channel terminal after the microphone spring plate is in contact with the microphone terminal of the headphone plug; in a process of pulling out the headphone plug from the headphone socket, the microphone spring plate breaks off contact with the microphone terminal of the headphone plug after the charging identifying detection spring plate breaks off contact with the right-channel terminal. Specifically, in the process of pulling out the headphone plug and in the process of inserting the headphone socket, a preferred solution for a sequence in which the spring plates break off contact with and are in contact with the terminals is described as follows:

First, as shown in FIG. 4, when the headphone plug is being pulled out from the headphone socket, the charging identifying detection spring plate 24 and the right-channel terminal 32 of the headphone plug are critically disconnected, so that an electrical connection between the charging detection availability identifying spring plate 24 and the right-channel terminal 32 is disconnected. Detection performed by the control circuit of the device on the headphones is an ineffective charging detection connected state, and in this case, the device does not charge the headphones. In this case, contact respectively between the headphone availability detection spring plate 25 and the left-channel terminal 31 of the headphone plug and between the left-earpiece spring plate 26 and the left-channel terminal 31 of the headphone plug, contact between the right-earpiece spring plate 23 and the right-channel terminal 32 of the headphone plug, contact between the microphone spring plate 21 and the microphone terminal 34 of the headphone plug, and contact between the grounded spring plate 22 and the grounded terminal 33 of the headphone plug still exist.

Figure 5:
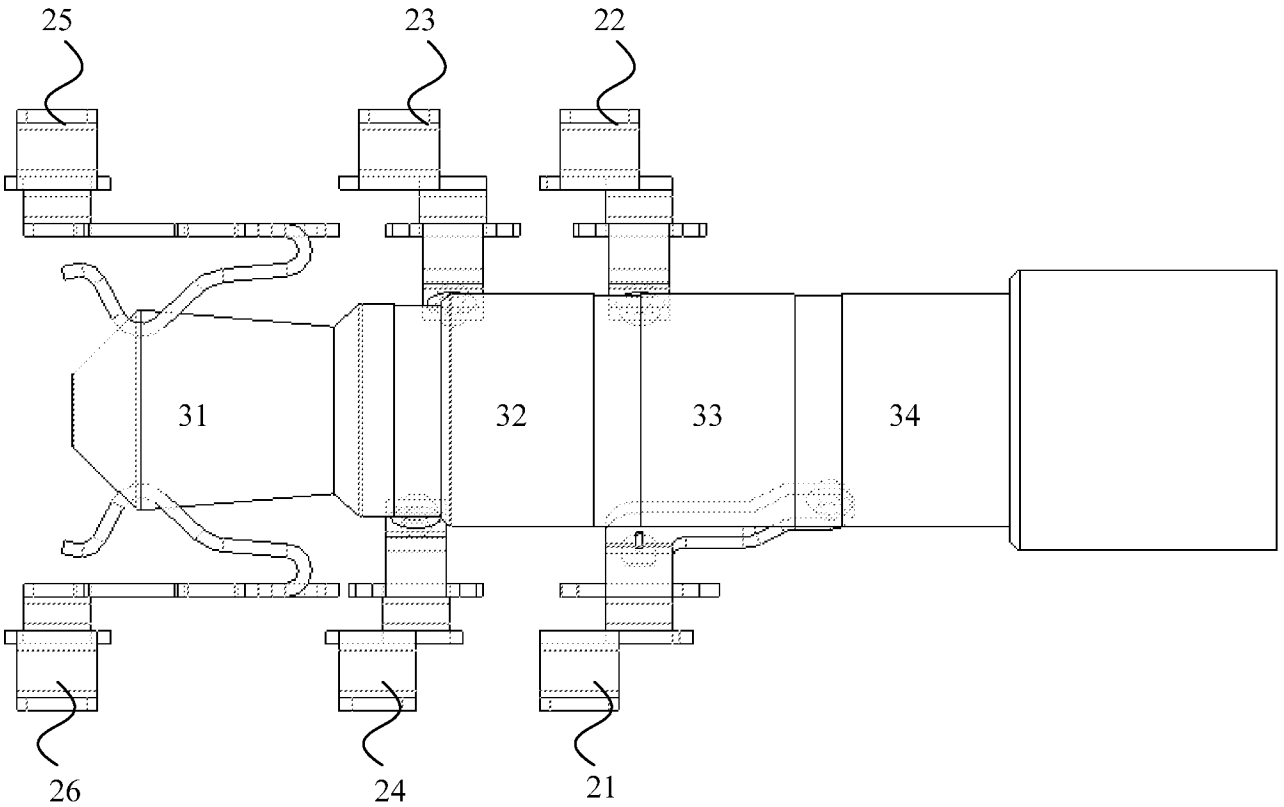
FIG. 5 is a schematic diagram of a third state of a headphone socket according to an embodiment of the present disclosure.

As shown in FIG. 5, as the headphone plug continues to be pulled out from the headphone socket, the charging identifying detection spring plate 24 completely disconnect from the right-channel terminal 32 of the headphone plug, the microphone spring plate 21 and the microphone terminal 34 of the headphone plug are in a critically disconnected state, and the contact respectively between the headphone availability detection spring plate 25 and the left-channel terminal 31 of the headphone plug and between the left-earpiece spring plate 26 and the left-channel terminal 31 of the headphone plug, the contact between the right-earpiece spring plate 23 and the right-channel terminal 32 of the headphone plug, and the contact between the grounded spring plate 22 and the grounded terminal 33 of the headphone plug still exist. In this case, the headphones are in a critically pulled-out state.

Figure 6:
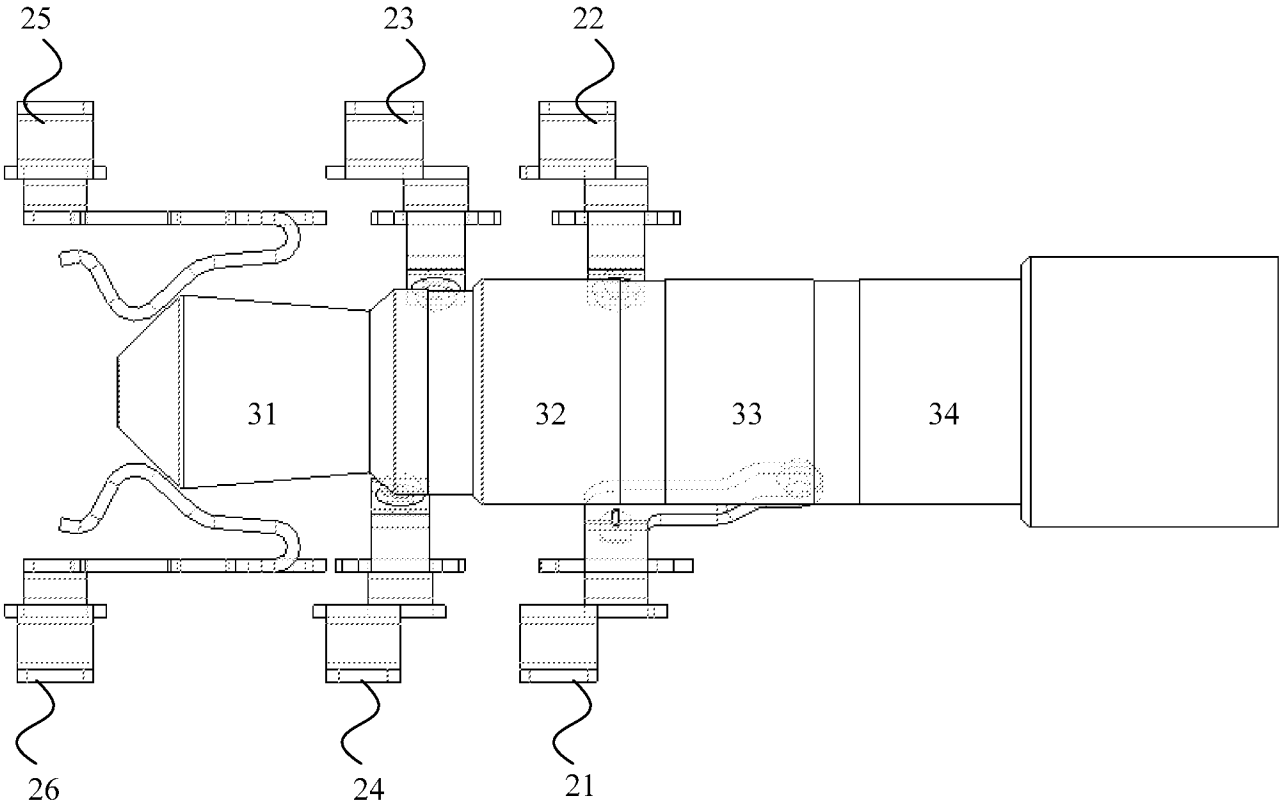
FIG. 6 is a schematic diagram of a fourth state of a headphone socket according to an embodiment of the present disclosure.

As shown in FIG. 6, as the headphone plug continues to be pulled out from the headphone socket, the spring plates of the headphone socket completely break off contact with the terminals of the headphone plug. In this case, the control circuit of the device detects that the headphones are not available, and the headphones are in a completely pulled-out state.

A process of inserting the headphone plug into the headphone socket is exactly the reverse of the foregoing process. In the process of inserting the headphone plug into the headphone socket, after the headphone availability detection spring plate 25 and the left-earpiece spring plate 26 are separately in contact with the left-channel terminal 31 of the headphone plug, the right-earpiece spring plate 23 is in contact with the right-channel terminal 32 of the headphone plug, and the grounded spring plate 22 is in contact with the grounded terminal 33 of the headphone plug, the microphone spring plate 21 is in contact with the microphone terminal 34 of the headphone plug, and finally, the charging identifying detection spring plate 24 is in contact with the right-channel terminal 32. In this way, noise generated due to instability of contact between the headphone plug and the headphone socket can be avoided.

A structure of the headphone socket in this embodiment of the present disclosure can be applied to various headphone sockets of different specifications, which may include but are not limited to a surface mount headphone socket and a sink board headphone socket when classified according to techniques, and may include but are not limited to a normal headphone socket and a waterproof headphone socket when classified according to purposes. When being classified according to spring plate arrangements, the headphone sockets may include but are not limited to a headphone socket with an arrangement in a time sequence of a left earpiece, a right earpiece, a microphone, and a ground, or in a time sequence of a left earpiece, a right earpiece, a ground, and a microphone.

According to the headphone socket provided in this embodiment of the present disclosure, an idle spring plate in an original headphone socket is used as a charging detection availability identifying spring plate, and the charging detection availability identifying spring plate is used to conduct a connection between a right-channel terminal and a control circuit, so that the control circuit controls a power supply circuit to charge headphones by using a microphone spring plate that is in contact with a microphone terminal of a headphone plug. In this way, not only a function of a standard headphone socket but also a function of charging the headphones can be implemented without increasing dimensions of the headphone socket. Therefore, a requirement on a capacity of an external battery of the headphones is also lowered, so that it is more convenient for a user to use and carry the headphones, and user experience is greatly improved.

In the foregoing specific implementation manners, the objective, technical solutions, and benefits of the present disclosure are further described in detail. It should be understood that the foregoing descriptions are merely specific implementation manners of the present disclosure, but are not intended to limit the protection scope of the present disclosure. Any modification, equivalent replacement, or improvement made without departing from the spirit and principle of the present disclosure should fall within the protection scope of the present disclosure.

What is claimed is:

1. A headphone socket, wherein the headphone socket comprising:

a headphone socket body; and a spring plate part configured to clamp into the headphone socket body and comprising a microphone spring plate, a grounded spring plate, a right earpiece spring plate, a charging detection availability identifying spring plate, a headphone availability detection spring plate, and a left earpiece spring plate, wherein the charging detection availability identifying spring plate is configured to contact a right channel terminal of a headphone plug inserted into the headphone socket so that a device associated with the headphone socket can charge headphones using the microphone spring plate through a connection with a microphone terminal of the headphone plug.

2. The headphone socket of claim 1, wherein, when the headphone plug is inserted into the headphone socket, the charging detection availability identifying spring plate is configured to contact the right channel terminal after the microphone spring plate contacts the microphone terminal.

3. The headphone socket of claim 1, wherein, when the headphone plug is pulled out from the headphone socket, the microphone spring plate is configured to break off contact with the microphone terminal after the charging detection availability identifying spring plate breaks off contact with the right channel terminal.

4. The headphone socket of claim 1, wherein the headphone socket body comprises a first end configured to dispose a headphone jack.

5. The headphone socket of claim 4, wherein the headphone socket body further comprises two side walls with opening structures.

6. The headphone socket of claim 5, wherein second ends of the microphone spring plate, the grounded spring plate, the right earpiece spring plate, the charging detection availability identifying spring plate, the headphone availability detection spring plate, and the left earpiece spring plate stretch out of the headphone socket body from corresponding opening structures and are configured to connect to a circuit of the device.

7. The headphone socket of claim 6, wherein third ends of the microphone spring plate, the grounded spring plate, the right earpiece spring plate, the charging detection availability identifying spring plate, the headphone availability detection spring plate, and the left earpiece spring plate are configured to contact the headphone plug.

* * * * *